US012781593B2

(12) United States Patent
Asthana et al.

(10) Patent No.: US 12,781,593 B2
(45) Date of Patent: Nov. 3, 2026

(54) CONFIGURABLE PROGRAMMABLE CHECK VALVE FOR WELL OPERATIONS

(71) Applicant: Saudi Arabian Oil Company, Dhahran (SA)

(72) Inventors: Pranay Asthana, Dhahran (SA); Bader AlQahtani, Dammam (SA); Ahmed Y. Bukhamseen, Dammam (SA); Suresh Jacob, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 19/276,159

(22) Filed: Jul. 22, 2025

(65) Prior Publication Data

US 2026/0298049 A1 Oct. 1, 2026

Related U.S. Application Data

(60) Provisional application No. 63/778,576, filed on Mar. 27, 2025.

(51) Int. Cl.
*E21B 34/06* (2006.01)
*E21B 34/08* (2006.01)

(52) U.S. Cl.
CPC ..... *E21B 34/063* (2013.01); *E21B 34/08* (2013.01); *E21B 2200/04* (2020.05); *E21B 2200/08* (2020.05)

(58) Field of Classification Search
CPC .... E21B 34/063; E21B 34/08; E21B 2200/04; E21B 2200/08
See application file for complete search history.

(56) References Cited

U.S. PATENT DOCUMENTS

2023/0144758 A1* 5/2023 Al Sulaiman ..... E21B 34/08 166/386
2024/0344625 A1* 10/2024 Prather ..... F16K 17/06
2025/0207472 A1* 6/2025 Schultz ..... E21B 23/10

* cited by examiner

*Primary Examiner* — James G Sayre
(74) *Attorney, Agent, or Firm* — DINSMORE & SHOHL LLP

(57) ABSTRACT

A valve assembly includes a first funnel and a second funnel each with a plurality of inlet ports. The first funnel and the second funnel narrow towards a connecting port defined by and penetrating through a pressure wall. The pressure wall is configured to, when the valve assembly is disposed on the tubular body, at least partially isolate the pressure of the interior of the tubular body from the pressure of the exterior of the tubular body. A first ball is enclosed within the first funnel which is configured to dissolve in response to contact with a first specified fluidic material. A second ball is enclosed within the second funnel which includes a coating around a core that is configured to dissolve in response to contact with a second specified fluidic material.

22 Claims, 12 Drawing Sheets

CONFIGURABLE PROGRAMMABLE CHECK VALVE FOR WELL OPERATIONS

TECHNICAL FIELD

This disclosure relates to downhole flow control for well operations.

BACKGROUND

Premature water breakthrough in hydrocarbon production from reservoirs can be a major challenge in oil and gas operations. Water production from sections, for example, along horizontal wells can be due to reservoir heterogeneity and can adversely impact hydrocarbon recovery, well life, and well economics. Inflow control devices are typically used to control water production from hydrocarbon reservoirs. These devices are classified as water management devices and usually put in a well as a proactive measure, hence they can have a future positive impact when water break through occurs.

SUMMARY

The subject matter herein relates to downhole flow control for well operations.

Certain aspects of the subject matter herein can be implemented as a valve assembly configured to be disposed on a tubular body, that is in turn configured to be disposed in a wellbore. The valve assembly includes a first funnel and a second funnel. The first funnel includes a plurality of inlet ports exposed to a pressure of an interior of the tubular body. The second funnel includes a plurality of inlet ports exposed to a pressure of an exterior of the tubular body. The first funnel and the second funnel narrow towards a connecting port which is defined by and penetrates through a pressure wall. The pressure wall is configured to, when the valve assembly is disposed on the tubular body, at least partially isolate the pressure of the interior of the tubular body from the pressure of the exterior of the tubular body. The valve assembly further includes a first ball enclosed within the first funnel which is configured to dissolve in response to contact with a first specified fluidic material, and a second ball enclosed within the second funnel which includes a coating around a core. The coating is configured to dissolve in response to contact with a second specified fluidic material.

Certain aspects of the subject matter herein can be implemented as a well production system. The system includes a tubular body disposed in a wellbore and valve assembly disposed on the tubular body. The valve assembly includes a first funnel and a second funnel. The first funnel includes a plurality of inlet ports exposed to a pressure of an interior of the tubular body. The second funnel includes a plurality of inlet ports exposed to a pressure of an exterior of the tubular body. The first funnel and the second funnel narrow towards a connecting port defined by and penetrating through a pressure wall. The pressure wall is configured to, when the valve assembly is disposed on the tubular body, at least partially isolate the pressure of the interior of the tubular body from the pressure of the exterior of the tubular body. The valve assembly further includes a first ball enclosed within the first funnel which is configured to dissolve in response to contact with a first specified fluidic material, and a second ball enclosed within the second funnel which includes a coating around a core. The coating is configured to dissolve in response to contact with a second specified fluidic material.

Certain aspects of the subject matter herein can be implemented as a method of well operations. The method includes disposing, in a wellbore, a tubular body with a wellbore valve assembly disposed thereon. The valve assembly includes a first funnel and a second funnel. The first funnel includes a plurality of inlet ports exposed to a pressure of an interior of the tubular body. The second funnel includes a plurality of inlet ports exposed to a pressure of an exterior of the tubular body. The first funnel and the second funnel narrow towards a connecting port defined by and penetrating through a pressure wall. The pressure wall is configured to, when the valve assembly is disposed on the tubular body, at least partially isolate the pressure of the interior of the tubular body from the pressure of the exterior of the tubular body. The valve assembly further includes a first ball enclosed within the first funnel which is configured to dissolve in response to contact with a first specified fluidic material, and a second ball enclosed within the second funnel which includes a coating around a core. The coating is configured to dissolve in response to contact with a second specified fluidic material. The method further includes, when the tubular body is disposed in the wellbore and the first ball in an un-dissolved state, increasing a pressure of the interior of the tubular body such that the pressure of the interior of the tubular body exceeds a pressure of the exterior of the tubular body, thereby urging the first ball against the connecting port, and then reducing the pressure in the interior of the tubular body such that the pressure of the exterior of the tubular body exceeds the pressure of the interior of the tubular body such that the first ball is pushed away from the ball seat, thereby permitting a flow of fluid through the connecting port from the exterior of the tubular body to the interior of the tubular body. The first ball at least partially dissolves in response to contact with the first specified fluidic material in the flow of fluid through the connecting port from the exterior of the tubular body to the interior of the tubular body. The coating of the second ball at least partially dissolves in response to contact with the second specified fluidic material in the flow of fluid through the connecting port from the exterior of the tubular body to the interior of the tubular body.

BRIEF DESCRIPTION OF THE DRAWINGS

Like reference numbers and designations in the various drawings indicate like elements.

DETAILED DESCRIPTION

Premature water breakthrough in hydrocarbon production from reservoirs can be a major challenge in oil and gas operations. Water production from sections, for example, along horizontal wells can be due to reservoir heterogeneity and can adversely impact hydrocarbon recovery, well life, and well economics. Inflow control devices are typically used to control water production from hydrocarbon reservoirs. These devices are classified as water management devices and usually put in a well as a proactive measure, hence they can have a future positive impact when water break through occurs.

Due to the working mechanism of typical autonomous inflow control devices (A-ICDs), they can restrict or choke unwanted fluids which may be composed of a certain water fraction, brine or salt infused fluids which could be injected or formation saline water. This can have a negative impact during the well clean-up operations, because during preceding drilling and completion operations several thousand barrels of water-based brine and drilling fluids are pumped into the well for reasons of well control with overbalance, friction reduction etc. At times, there are losses due to the fluid entering formation. Some or all of these fluids may need to be recovered from the reservoir before the well can kickoff either with natural flow or nitrogen lift.

This disclosure relates to downhole inflow control, and in particular, downhole autonomous well cleanup through flow back while also allowing for tubing pressure integrity check, washpipe-free setting of packers, and future autonomous remedial stimulation through injection into the reservoir, using an autonomous flowback device (A-FBD) that utilizes a configurable programmable check valve (CPCV). As described in greater detail below, a CPCV includes two modules: a configurable injection flow module (CIFM) and a configurable production flow module (CPFM). The CPCV can enable flowback through accelerated clean-up of new or reworked oil wells, including those that are drilled and completed with A-ICDs and flow control systems that have no connectivity from surface and therefore no surface control.

Multiple CPCVs can be used in tandem to create flow logic circuit(s) to create specific actuation(s) and control, thus enabling various application specific configurations. In other configurations, single or multiple CPFMs can be paired with single or multiple CIFMs forming many possible hybrid CPCV versions and combinations, which in turn could be used in tandem to create many possible hydraulic logic circuits.

Figure 1:
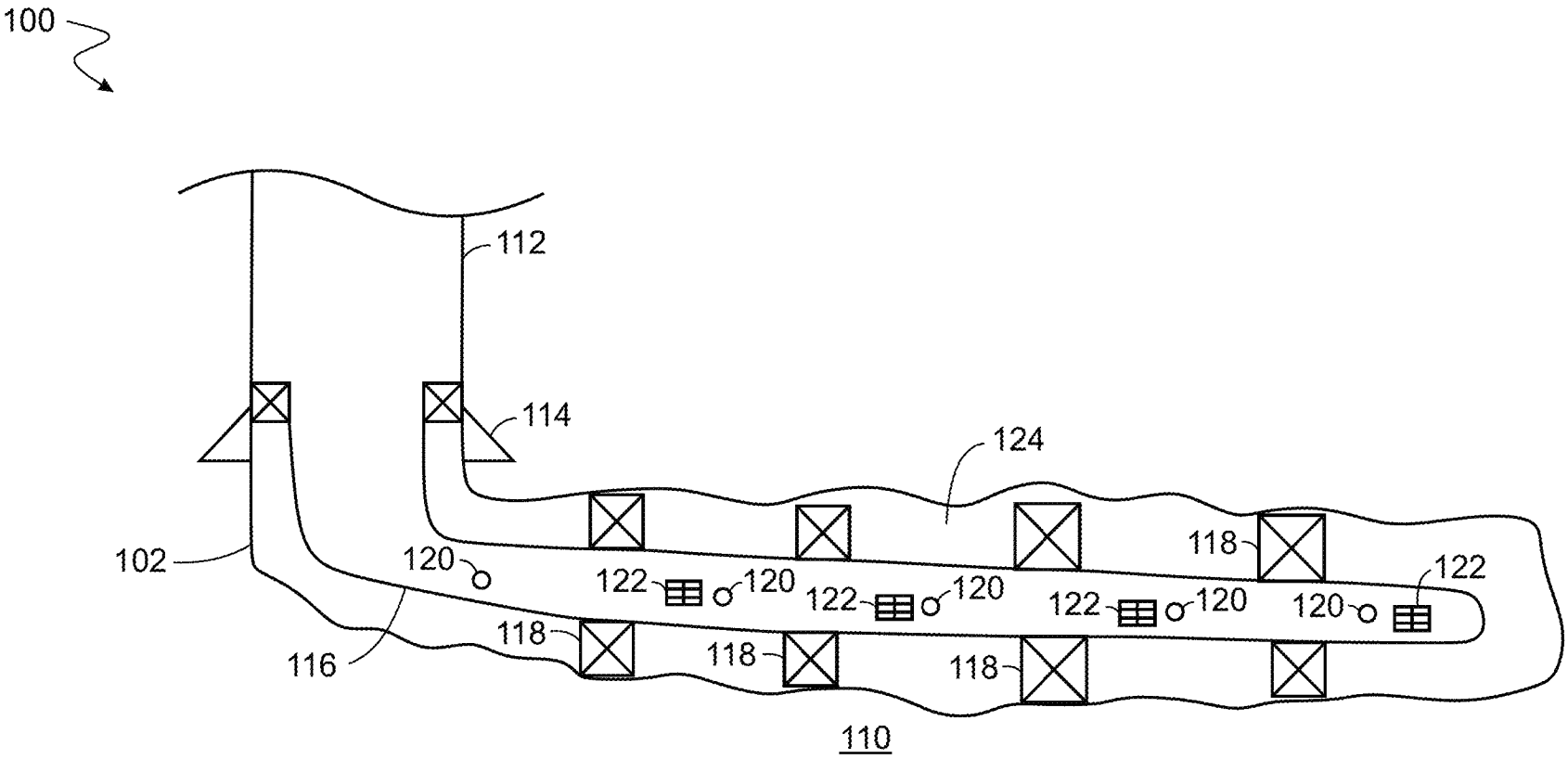
FIG. 1 is a schematic illustration of a well system in accordance with embodiments of the present disclosure.

FIG. 1 depicts an example well system 100 constructed in accordance with the concepts herein. The well system 100 includes a wellbore 102 that extends from the surface through the Earth to one more subterranean zones of interest 110 (one shown). Wellbore 102 enables access to the subterranean zones of interest 110 to allow recovery (that is, production) of fluids to the surface and, in some implementations, additionally or alternatively allows fluids to be placed in the Earth. In some implementations, the subterranean zone 110 is a formation within the Earth defining a reservoir, but in other instances, the zone 110 can be multiple formations or a portion of a formation. The subterranean zone can include, for example, a formation, a portion of a formation, or multiple formations in a hydrocarbon-bearing reservoir from which recovery operations can be practiced to recover trapped hydrocarbons. In some implementations, the subterranean zone includes an underground formation of naturally fractured or porous rock containing hydrocarbons (for example, oil, gas, or both). In some implementations, the well can intersect other types of formations, including reservoirs that are not naturally fractured. Wellbore 102 can be a vertical wellbore or a deviated wellbore deviated from vertical (for example, horizontal or slanted). The well system 100 can include multiple wellbore forming a multilateral well (that is, a well having multiple lateral wellbores branching off another well or wells).

In some implementations, the well system 100 is a gas well system that is used in producing hydrocarbon gas (such as natural gas) from the subterranean zones of interest 110 to the surface. While termed a "gas well," the well need not produce only dry gas, and may incidentally or in much smaller quantities, produce liquid including oil, water, or both. In some implementations, the well system 100 is an oil well system that is used in producing hydrocarbon liquid (such as crude oil) from the subterranean zones of interest 110 to the surface. While termed an "oil well," the well not need produce only hydrocarbon liquid, and may incidentally or in much smaller quantities, produce gas, water, or both. In some implementations, the production from the well system 100 can be multiphase in any ratio. In some implementations, the production from the well system 100 can produce mostly or entirely liquid at certain times and mostly or entirely gas at other times. For example, in certain types of wells it is common to produce water for a period of time to gain access to the gas in the subterranean zone. The concepts herein, though, are not limited in applicability to gas wells, oil wells, or even production wells, and could be used in wells for producing other gas or liquid resources or could be used in injection wells, disposal wells, or other types of wells used in placing fluids into the Earth.

The wellbore 102 of the well system 100 is typically, although not necessarily, cylindrical. All or a portion of the wellbore 102 is lined with a tubing, such as casing 112. The casing 112 connects with a wellhead at the surface and extends downhole into the wellbore 102. The casing 112 operates to isolate the bore of the wellbore 102, defined in the cased portion of the wellbore 102 by the inner bore of the casing 112, from the surrounding Earth. The casing 112 can be formed of a single continuous tubing or multiple lengths of tubing joined (for example, threadedly) end-to-end. In some implementations, the casing 112 is perforated in the subterranean zone of interest 110 to allow fluid communication between the subterranean zone of interest 110 and the bore of the casing 112. In some implementations, the casing 112 is omitted or ceases in the region of the subterranean zone of interest 110 (as shown in FIG. 1). This portion of the well 100 without casing is often referred to as "open hole." In the embodiment shown in FIG. 1, the cased portion of the well 100 can cease at a casing shoe 114.

A production tubing 116 can be installed in the casing 112. The production tubing 116 can extend into the open hole portion of the wellbore 102. An annulus 124 is defined by the exterior of production tubing 114 and the wall of the wellbore 102. The production tubing 116 can be secured by one or more packers 118. While FIG. 1 depicts four packers 118, the well system 100 can include fewer or more packers depending, for example, on the length of the production tubing 116. Each packer 118 surrounds the production tubing 116 and isolates separate annular volumes of annulus 124. Packers 118 also center the production tubing 116 within the wellbore 102 and stabilize the production tubing 116 during well operations.

The well system 100 can include one or more inflow control devices (ICDs) 120. The ICDs 120 can, for example, control the flow of fluids from the wellbore 102 and into the production tubing 116. While FIG. 1 depicts five ICDs 120 distributed along the production tubing 116, the well system 100 can include fewer or more ICDs depending, for example, on the length of the production tubing 116, characteristics of the well 100 along the length of the production tubing 116, or a combination of both.

Figure 2:
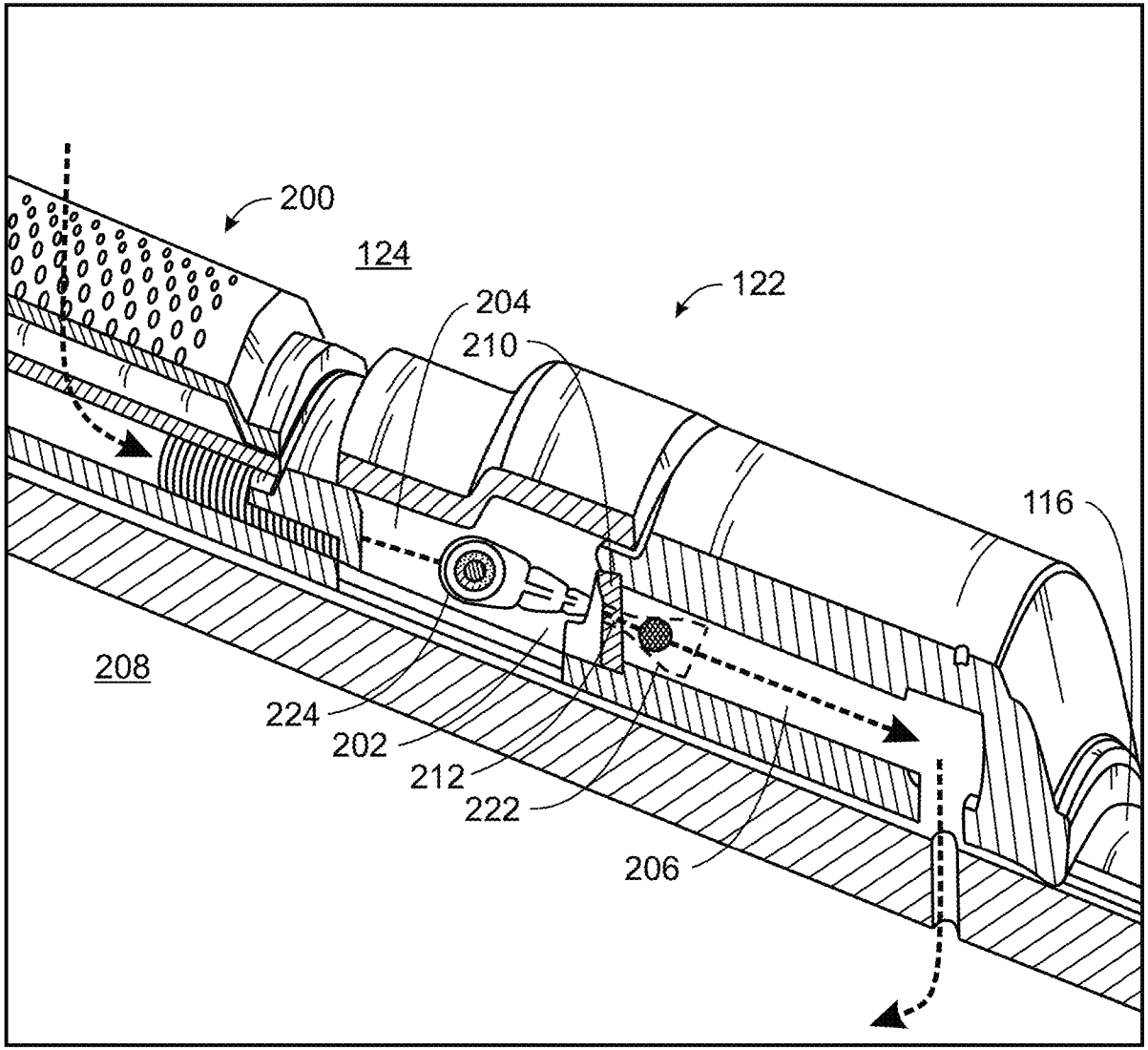
FIG. 2 is a schematic illustration of an autonomous flowback device in accordance with embodiments of the present disclosure.

The well system 100 includes one or more autonomous flowback devices (A-FBDs) 122. The A-FBDs 122 can, for example, be constructed on, or connected to be part of, the production tubing 116. While FIG. 1 depicts four A-FBDs 122 distributed along the production tubing 116, the well 100 can include fewer or more A-FBDs depending, for example, on the length of the production tubing 116, characteristics of the well 100 along the length of the production tubing 116, or a combination of both. (In some embodiments, one or more A-FBDs 122 can be installed downhole as sub-assemblies of subs that can be threaded onto production tubing. An example of such a sub is described below in reference to FIGS. 6A-6C.) In the embodiment shown in FIG. 2, each A-FBD 122 includes a perforated sleeve assembly 200 that surrounds the production tubing 116. Each A-FBD 122 includes a CPCV 202. As shown in FIG. 2, CPCV 202 is disposed within an fluid passageway 204 between sleeve assembly 200 and the wall of production tubing 116. The dotted lines in FIG. 2 depict flow of fluid 206 from annulus 124, through CPCV 202 and into the central bore 208 of production tubing 116 (or, if flowing in the opposite direction, from the central bore 208 through CPCV 202 out to annulus 124). As described in greater detail below, CPCV 202 includes a CIFM 222 and a CPFM 224 separated in part by a pressure wall 210 which is installed within sleeve assembly 202. Pressure wall 210 at least partially isolates the pressure within central bore 208 from pressure exterior of the tubular body (i.e., of the annulus 124). A connecting port 212 penetrates through (and is defined by) pressure wall 210 and fluidically connects an outlet of CIFM 222 with an outlet of CPFM 224.

Figure 3:
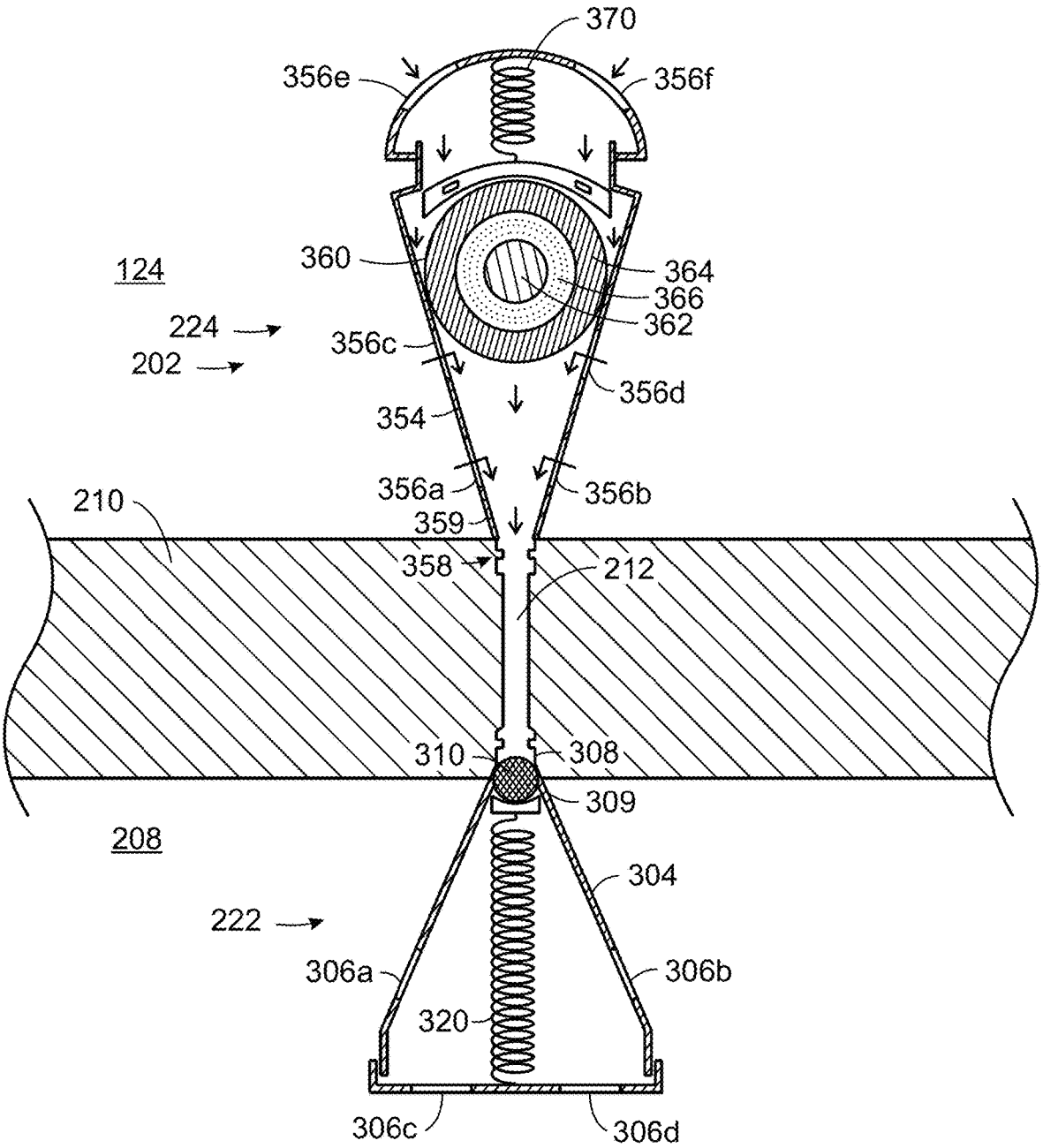
FIG. 3 is a schematic illustration of a configurable programmable check valve in accordance with embodiments of the present disclosure.

FIG. 3 depicts CIFM 222 and CPFM 224 of CPCV 202 in greater detail, in accordance with embodiments of the present disclosure. Referring to FIG. 3, each of CIFM 222 and CPFM 224 comprise a respective funnel (specifically, funnel 304 of CIFM 222 and funnel 354 of CPFM 224). Each of funnels 304 and 354 narrow towards connecting port 212 which, as described above, penetrates through a pressure wall 210

Funnel 304 of CIFM 222 includes a plurality of inlet ports 306*a*, 306*b*, 306*c*, and 306*d* exposed to a pressure of bore 208. Some embodiments of funnel 304 may have a greater or lesser number of inlet ports. An outlet port 308 at the narrow end of the funnel includes a seat 309 is fluidically connected to connecting port 212 through a mechanical anchor and seal system (for example, a thread and O-ring system).

A ball 310 is enclosed within funnel 304. In the illustrated embodiment, ball 310 is spherical; however, in some embodiments, ball 310 may be non-spherical and it will be understood that the term "ball" as used herein encompasses spherical shapes and also and non-spherical objects such as ovaloids and also 3-D geometries such as cones, mushroom, darts, or ellipsoids that can form a 360-degree line contact inside the funnel creating a seal with the seat 309 at outlet port 308. Ball 310 can be solid or hollow, and can be comprised of an organic or inorganic material comprised of a material configured to dissolve in the presence of a specified fluid such as water (or an aqueous mixture), hydrocarbons, or fluid configured to be injected for stimulation purposes such as brine, stimulation fluids, or other suitable chemical mixtures. Some examples include Magnesium alloys and compounds, Silica and clay compounds including their oxides, Fe based oxides, Titanium based oxides, organometallic compounds or salts of zinc, titanium, calcium, and magnesium, metal salts, metal catalysts, polyvinyl alcohol (PVA), Hydropol, Polysaccharides] Ball 310 can be configured to dissolve at specified dissolution rate. In some embodiments, a mechanical leverage assembly 320 (including but not limited to example shown as a coiled-spring connected to a pressing pad) is positioned within funnel 304 and is configured to bias ball 310 towards outlet port 308. Leverage assembly 320 can apply supplementary force to push ball 310 towards outlet port 308 without restricting flow through inlet ports. Leverage assembly could be a push or pull system. Part or all of leverage assembly 320 may be configured to be dissolvable.

Funnel 354 of CPFM 224 includes a plurality of inlet ports 356*a*, 356*b*, 356*c*, 356*d*, 356*e*, and 356*f* and 306*d* exposed to a pressure of annulus 124. Some embodiments of funnel 354 may have a greater or lesser number of inlet ports. An outlet port 358 at the narrow end of the funnel includes a seat 359 and is fluidically connected to connecting port 212 through a mechanical anchor and seal system (for example, a thread and O-ring system).

A ball 360 is enclosed within funnel 354. In the illustrated embodiment, ball 360 is spherical; however, in some embodiments, similar to ball 310, ball 360 may in some embodiments be non-spherical and/or may have any one or more of the various 3-D geometries described above with respect to ball 310. Ball 360 comprises a non-dissolvable (or substantially non-dissolvable) core 362 with a one or more coatings around a core 362. In the embodiment shown in FIG. 3, ball 360 includes a first coating 364 and a second coating 366, with second coating 366 in contact with core 362 and first coating 364 disposed around (on top of) second coating 366. Other embodiments may have only one coating, or may have a greater number of coatings (such as three or four coatings or more.) Coatings 364 and 366 can be comprised of an organic or inorganic material configured to dissolve in the presence of a specified fluid such as water (or an aqueous mixture), hydrocarbons, or fluids produced from reservoir and/or injected for stimulation purposes such as brine, stimulation fluids, or other suitable chemical mixtures. In some embodiments, one or more of ball 310 and the coatings of ball 360 are configured to dissolve in the same specified fluids as one or more of the others. In some embodiments, one or more of ball 310 and the individual coatings of ball 360 are configured to dissolve in different specified fluids. So, for example, in some embodiments, each of ball 310 and coatings 364 and 366 of ball 360 may be dissolvable in the same fluid composition (for example, water). In some embodiments, ball 310 may be configured to dissolve in water and one or more of coatings 364 and 366 may be configured to dissolve in hydrocarbons. In another embodiment, ball 310 may be configured to dissolve in water, coating 364 may be configured to dissolve in a mixture of water and hydrocarbons, and coating 364 may be configured to dissolve in a non-aqueous hydrocarbon mixture. In some embodiments, the dissolution rates of one or more of ball 310 and the coatings of ball 360 may have different dissolution rates from the others.

Thus, in some embodiments, first coating 364 can be configured to dissolve at a first dissolution rate in response to being exposed to targeted well fluid. Second coating 366 can be configured to dissolve at a second dissolution rate different from the first dissolution rate in response to being exposed to targeted well fluid. Some embodiments could be a third, fourth or nth coating if necessary following similar process as disclosed above. In some implementations, the second dissolution rate of the second coating is less than the first dissolution rate of the first coating. In some implementations, the first coating has a first thickness, and the second coating has a second thickness. In some implementations, there is only a first coating with a first thickness. In some implementations, a difference between the first thickness of the first coating and the second thickness of the second coating is less than 0.1 centimeters.

In some embodiments, a mechanical leverage assembly 370 (including but not limited to example shown as a coiled-spring connected to a pressing pad) is positioned within funnel 354 and is configured to bias ball 360 towards outlet port 358. Leverage assembly 370 can apply supplementary force to push ball 360 towards outlet port 358 without restricting flow through inlet ports. Leverage assembly could be a push or pull system. Part or all of leverage assembly 370 may be configured to be dissolvable.

Figure 6A:
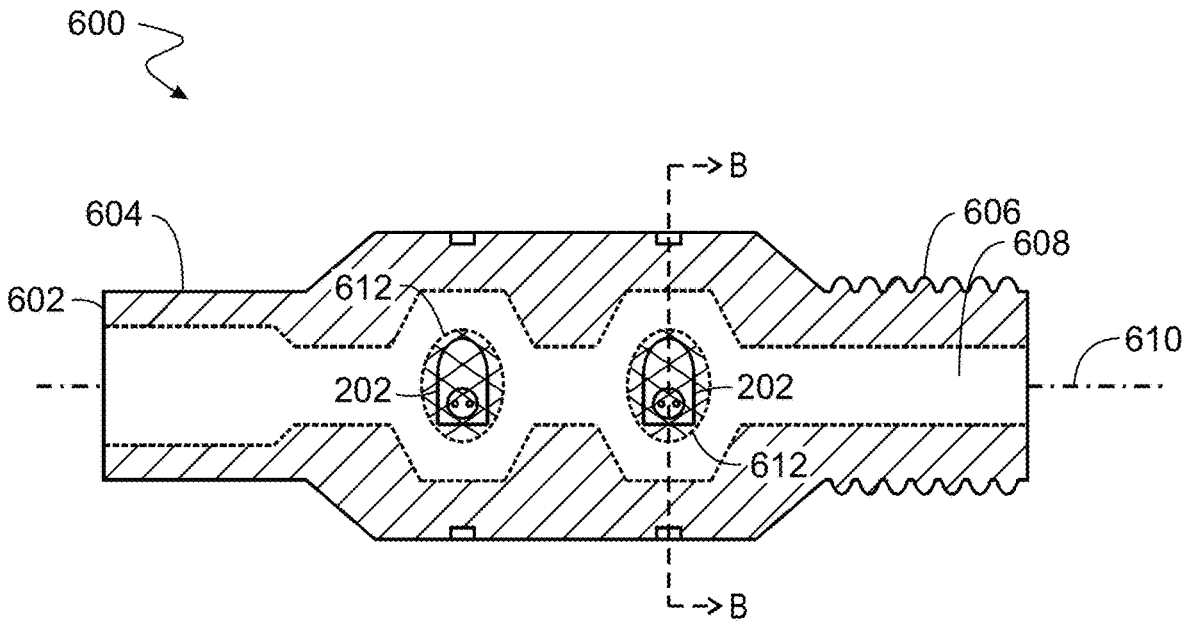
FIGS. 6A-6C are schematic illustrations of a tubing sub with configurable programmable check valves (Autonomous Flow back Device, A-FBD) in accordance with embodiments of the present disclosure.
Figure 6B:
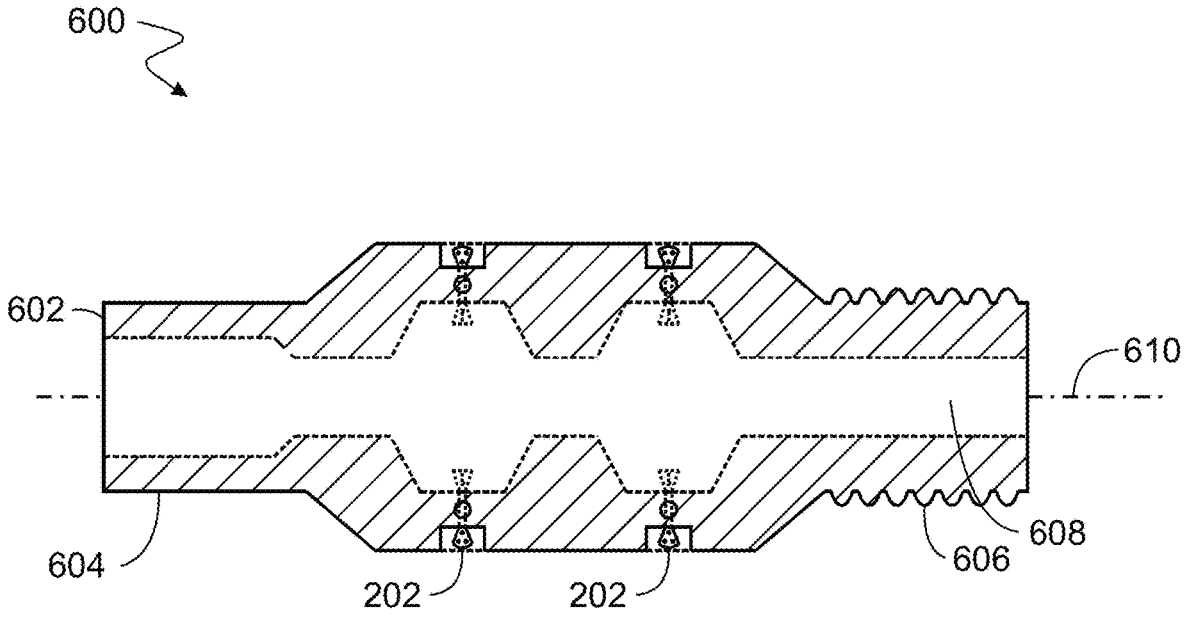
Figure 6C:
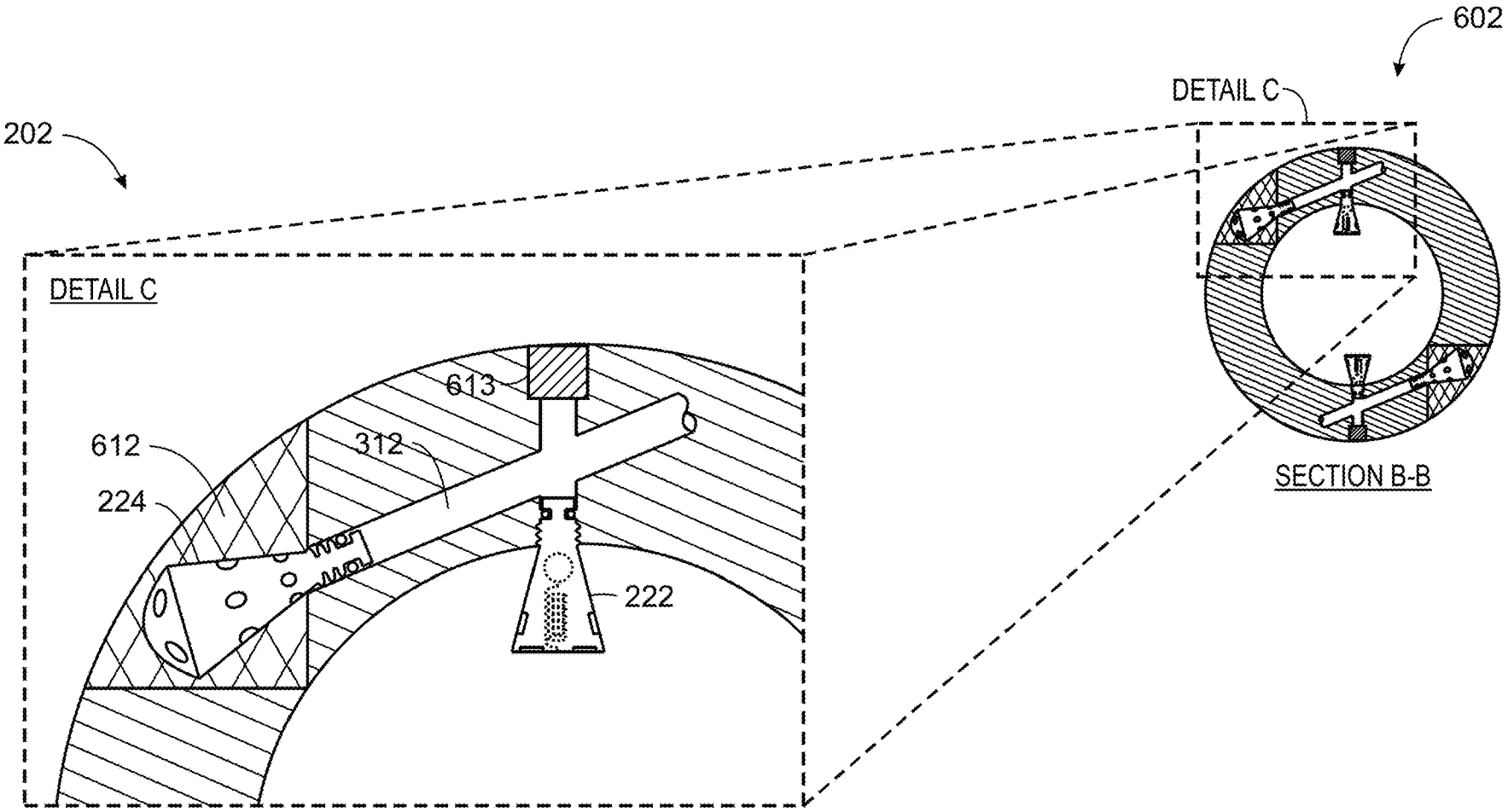

In some implementations, one or both of funnels 304 and 354 can include a first end, a second end, and a wall that spans from the first end to the second end. In some implementations, the wall defines a longitudinal axis through the first end and the second end. In some implementations, the wall has a first cross-sectional area at the first end and a second cross sectional area at the second end. In some implementations, the first cross-sectional area and the second cross-sectional area are perpendicular to the longitudinal axis. In some implementations, the first cross-sectional area is greater than the second cross-sectional area. In some implementations, the core coated with the first coating, and optionally the second coating, is disposed between the first end and the second end of the funnel. In some implementations, a first inlet port of the multiple inlet ports is disposed on the first end of the funnel. In some implementations, the outlet port is disposed on the second end of the funnel. In some implementations, a second inlet port of the multiple inlet ports is disposed on the wall of the funnel at a first distance from the first end along the longitudinal axis. In some implementations, the wall has a third cross-sectional area at the first distance. In some implementations, the third cross-sectional area is perpendicular to the longitudinal axis. In some implementations, the third cross-sectional area has an inner diameter that is less than the third outer diameter and greater than the second outer diameter. In some implementations, a third inlet port of the multiple ports is disposed on the wall of the funnel at a second distance from the first end along the longitudinal axis. In some implementations the CPFM 224 and CIFM 222 can be connected at different cross-sections and different planes through cross drills that can be disposed in different cross sections and planes as well. An example of this is shown in FIG. 6C.

Figure 4:
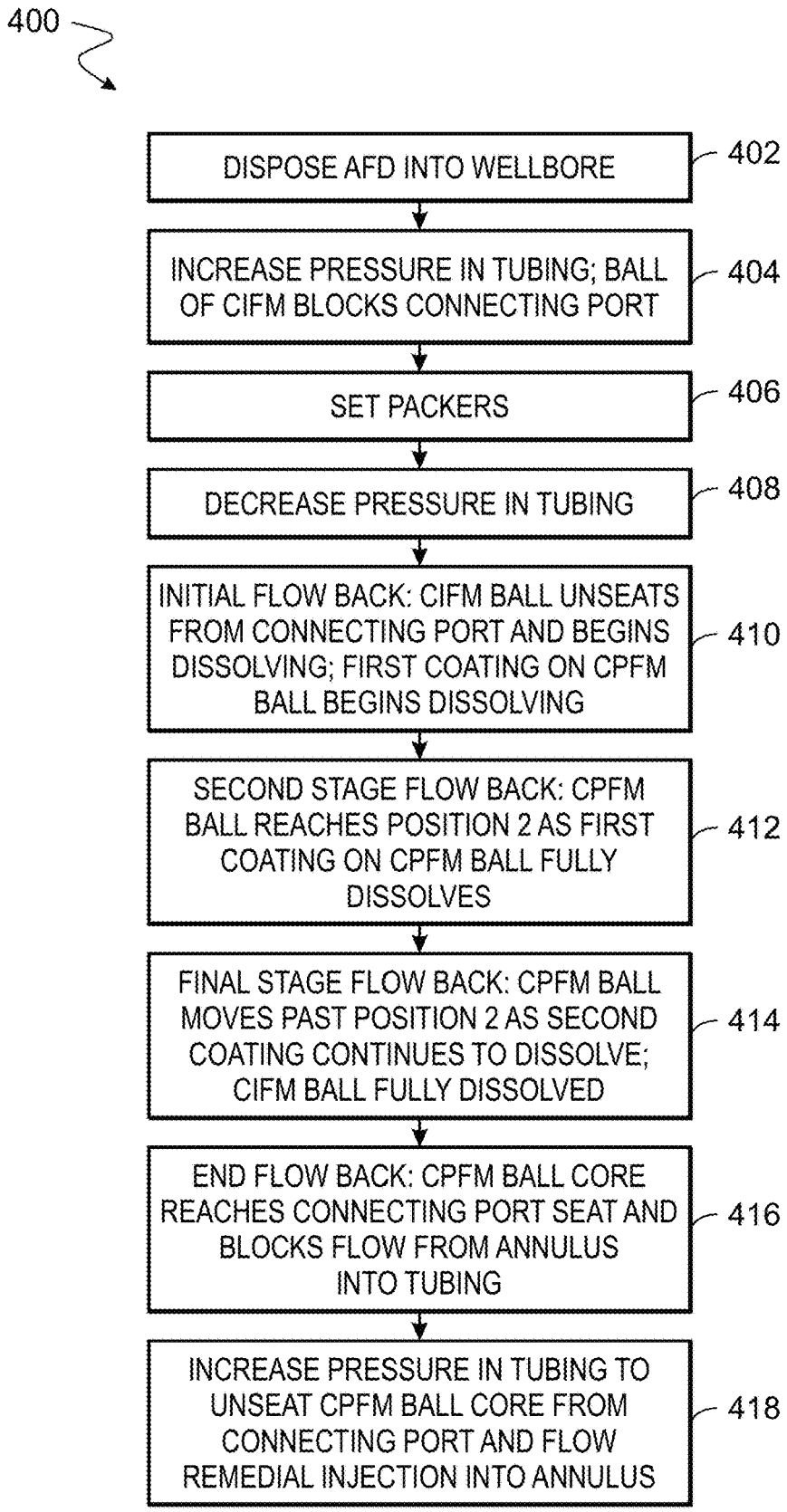
FIG. 4 is a process flow diagram of a method of operation of configurable programmable check valve in accordance with embodiments of the present disclosure.
Figure 5A:
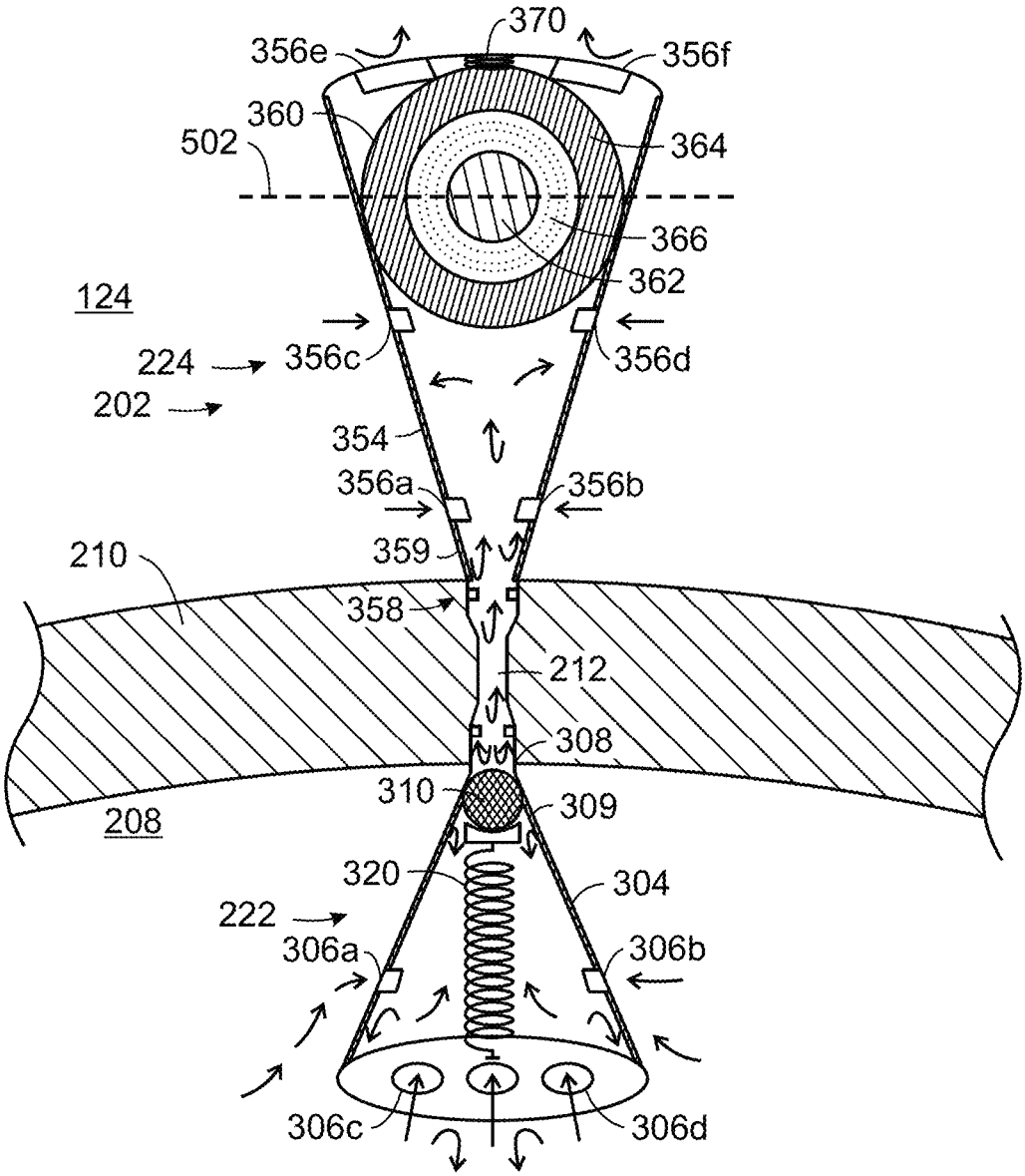
FIGS. 5A-5F are schematic illustrations the operation of a configurable programmable check valve described in reference to FIG. 4.

FIG. 4 is a process flow diagram of a method 400 method of flow control in accordance embodiments of the present disclosure. Method 400 is described in reference to the system and components described in the above-described FIGS. 1-3 and below-described FIGS. 5A-5F; however, it will be understood that method 400 can be used with other suitable systems and components. Method 400 begins at step 402 with an operator disposing into a wellbore production tubing 116 that includes one or more CPCVs 202, each of which includes, as described above, a CIFM 222 and a CPFM 224, as shown in FIG. 5A. Proceeding to step 404, pressure in bore 208 of production tubing 116 is increased such that the pressure in bore 208 exceeds the pressure in annulus 124. This pressure differential urges the ball 310 against the seat of connecting port 212, at blocking (or substantially blocking) flow through connecting port 312. This blocking of the flow permits further tubing pressure build up as may be desired to, at step 406, set pressure-activated packers or accomplish other system tasks which may require a specified tubing pressure.

Figure 5B:
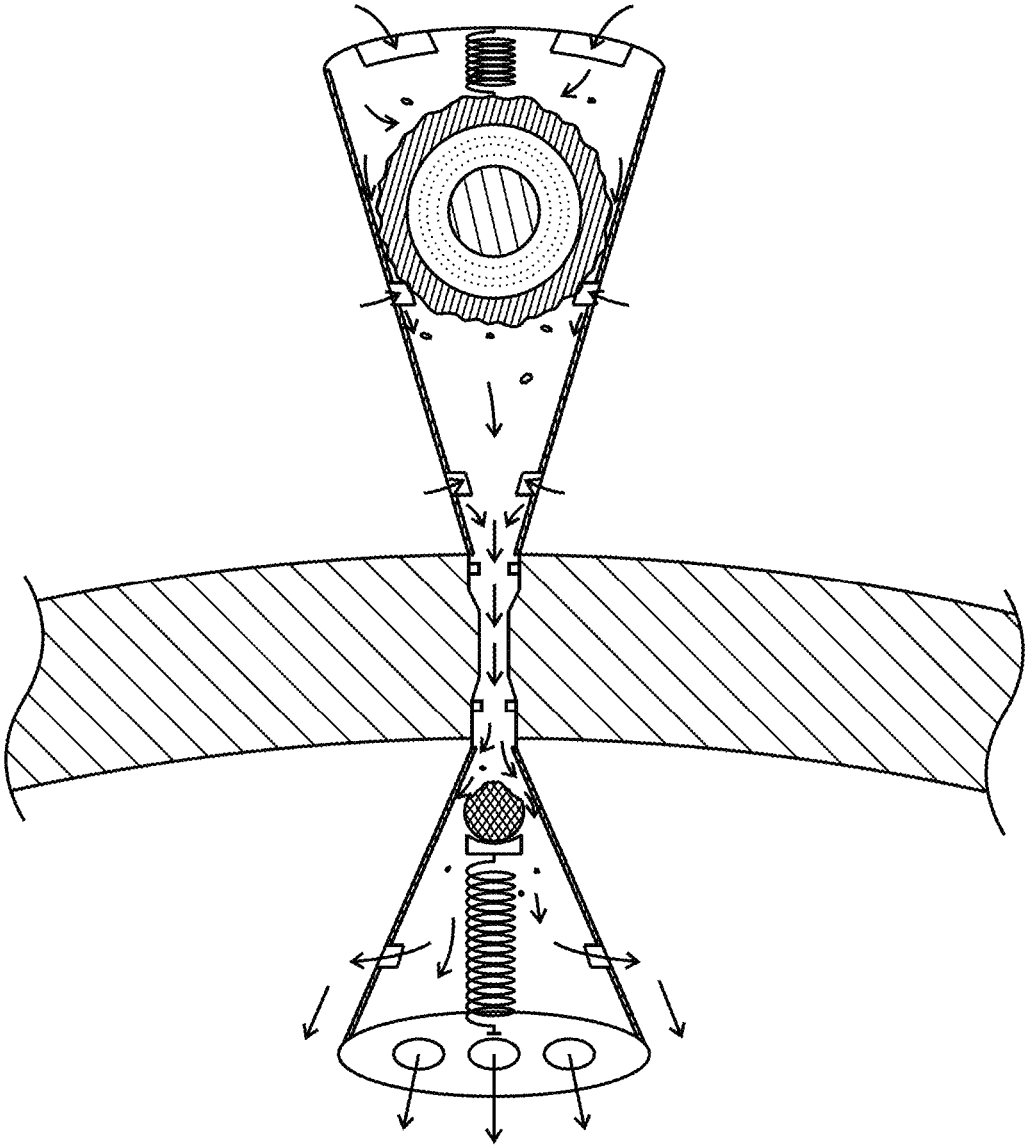

After the desired degree and duration of tubing pressure has been achieved, then, at step 408, pressure in tubing 116 can be decreased. When tubing pressure has been sufficiently decreased such that the pressure of annulus 124 exceeds the pressure in bore 208, then at step 410, pressure from annulus 124 unseats ball 310 and pushes it away from connecting port 312, thus permitting fluid to begin to flow from annulus 124 through connecting port 312 into CIFM 222. At the beginning of step 410, the diameter of ball 360 is sufficient to prevent its movement towards outlet 358, thus holding ball 360 in its first position (shown as position 502 in FIG. 5A), furthest from outlet 358. As flow continues connecting port 312, first coating 364 of ball 360 begins to dissolve in response to contact with the flowing fluid, and likewise ball 310 begins to dissolve. The resulting reduction in a diameter of the ball 360 as first coating 364 dissolves permits ball 360 translate within funnel 354 towards outlet 358 (i.e., towards connecting port 312), as shown in FIG. 5B, thereby at least partially blocking some of the inlet ports of funnel 354 and progressively reducing the flow of fluid through the connecting port 312 as ball 360 so translates.

Figure 5C:
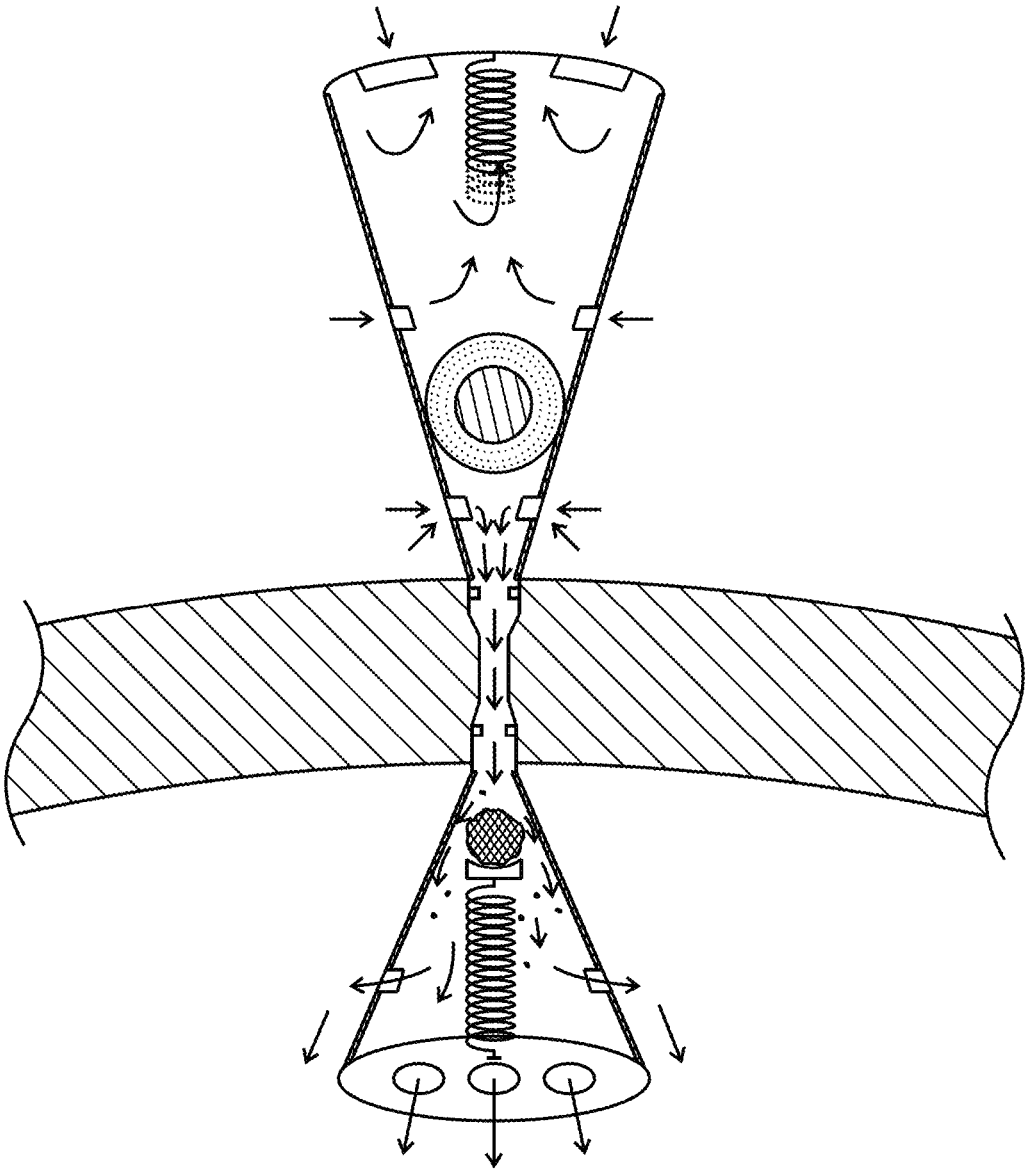
Figure 5D:
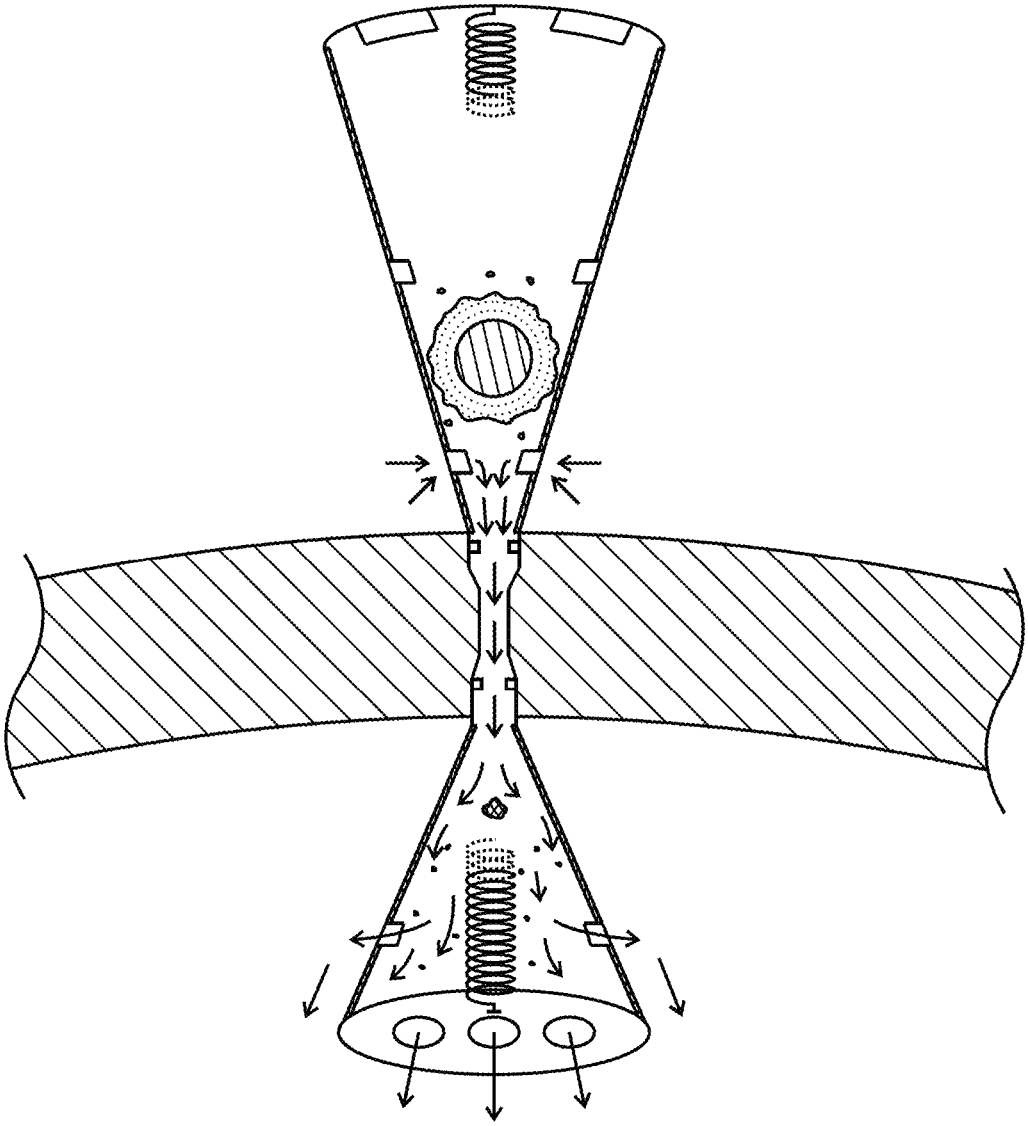
Figure 5E:
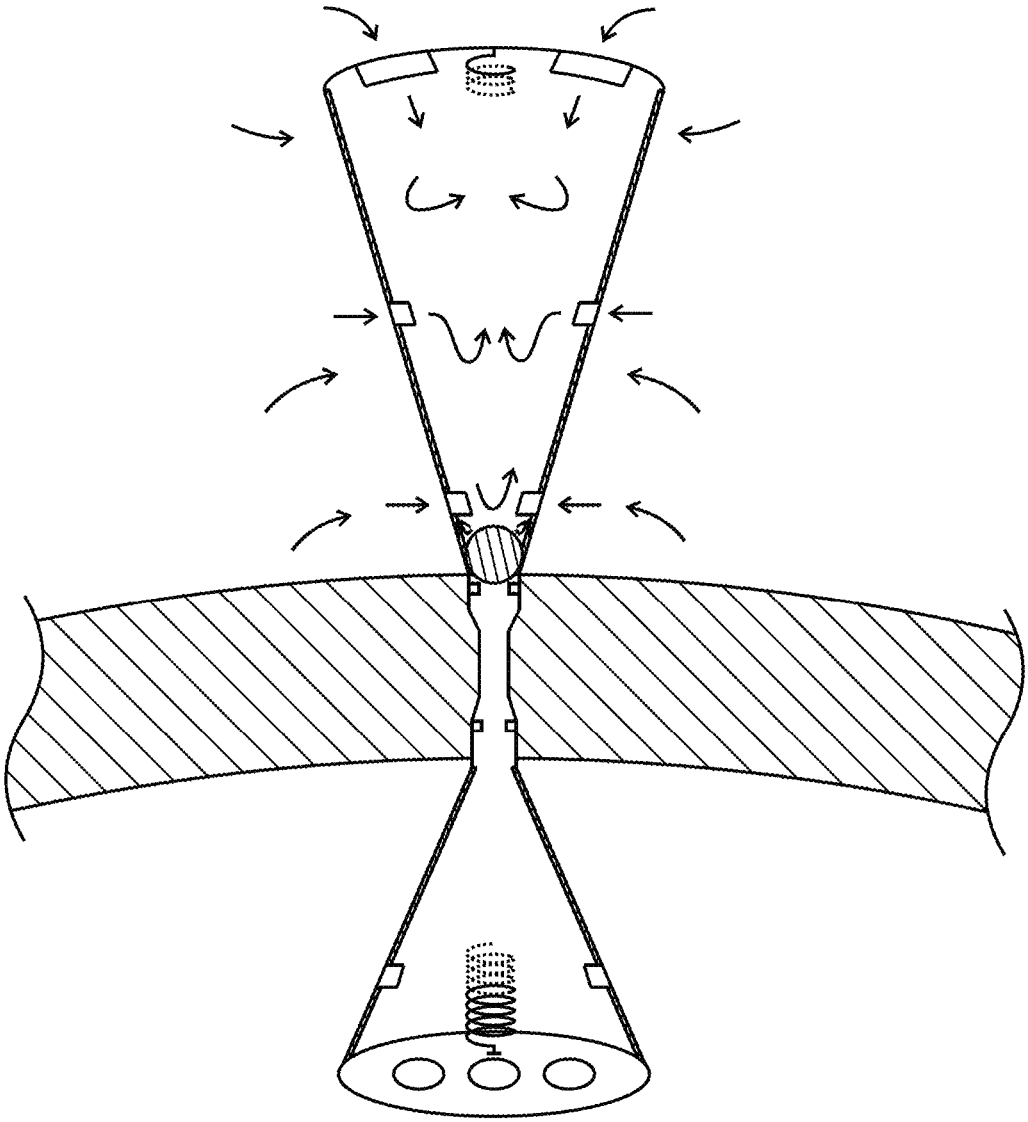
Figure 5F:
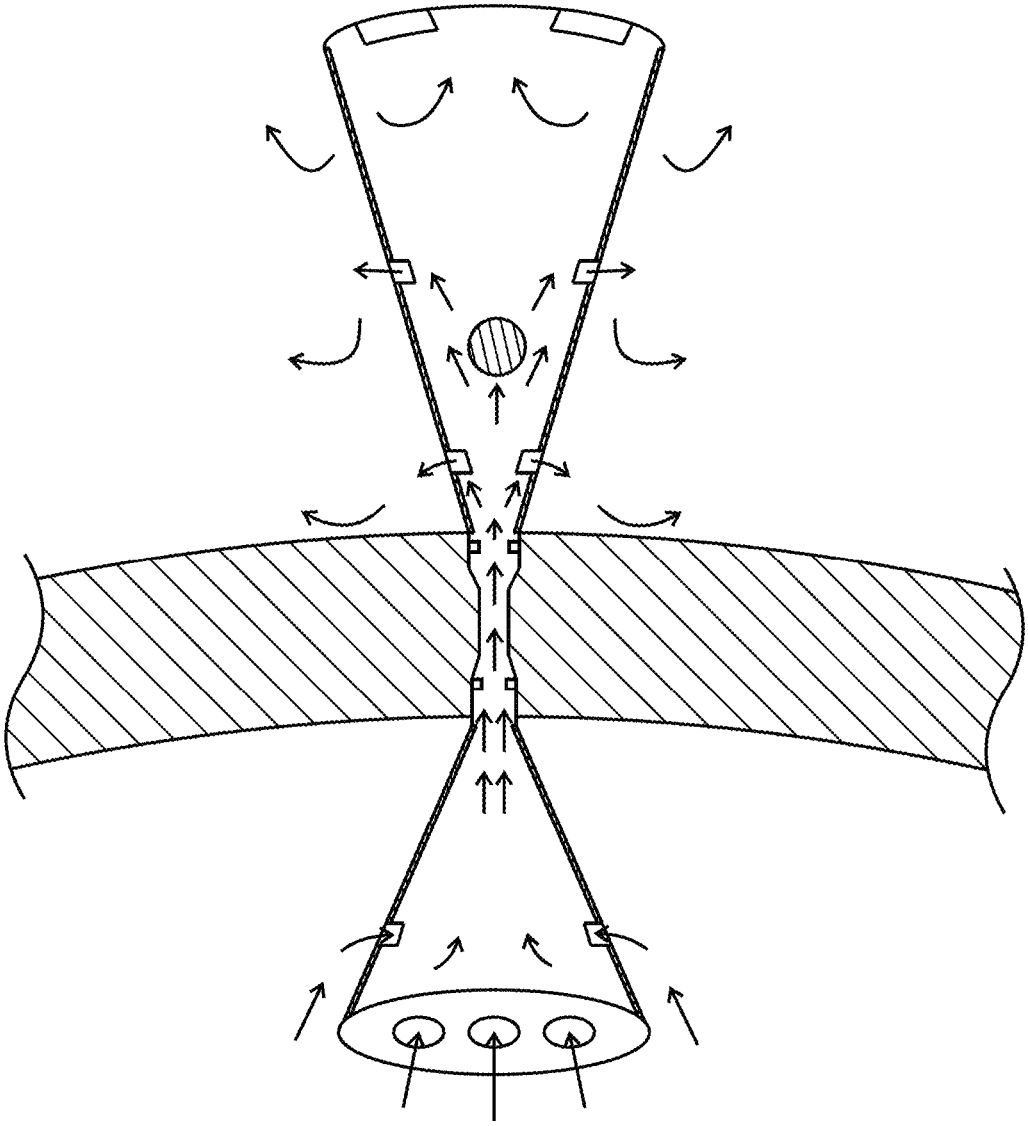

When all (or substantially all) of first coating 364 has dissolved, then, at step 412 and as shown in FIG. 5C, ball 360 has reached a second position (shown as position 504 in FIG. 5C). At step 414, second coating 366 begins to dissolve, as shown in FIG. 5D. By this step, ball 310 may have fully dissolved. At step 416, second coating 366 is fully dissolved and core 362 is urged against the communication port (and seats at seat 359) by continued pressure from annulus 124. As shown in FIG. 5E, core 362 substantially prevents flow of fluid through connecting port 312 from annulus 124 to central bore 208. If stimulation operations (or other operations involving injection of fluids into annulus 124) are desired then, at step 418, as shown in FIG. 5F, pressure in central bore 208 can be increased, thereby unseating core 362 to open connecting port 312 such that a fluid (such as a stimulation fluid) can be flowed from central bore 208 to annulus 124.

In some embodiments, an A-FBD can be in the form of a sub or pup joint with threaded connections that can be attached between production tubing segments. An example of such a configuration is shown as sub 602 of FIGS. 6A-6C. FIG. 6A is an exterior side view, and FIG. 6B is an exterior top view, of sub 600. Sub 600 includes a main body 602 with a central bore 608 and threaded ends 604 and 606. Four CPCVs 202 (as described in reference to FIG. 3 above) are embedded into the walls of main body 602. Debris barriers 612 (such as a filter or screen) within scalloped cuts can prevent particulates or other solids from entering the CPCVs. FIG. 6C is a cross-sectional view showing the relative placements of a CPFM 224 and CIPM 222 (as described above in reference to FIG. 3) and connecting port 312 within a sub 602. Connecting port 312 may be drilled into main body 602 and seal plug 613 inserted to isolates connecting port 312 after installation. Sub 602 can be easily threaded to tubular segments of a completion string.

Examples

In a first aspect, a valve assembly configured to be disposed on a tubular body, that is in turn configured to be disposed in a wellbore, includes a first funnel and a second funnel. The first funnel includes a plurality of inlet ports exposed to a pressure of an interior of the tubular body. The second funnel includes a plurality of inlet ports exposed to a pressure of an exterior of the tubular body. The first funnel and the second funnel narrow towards a connecting port, which is connecting port defined by and penetrates through a pressure wall. The pressure wall is configured to, when the valve assembly is disposed on the tubular body, at least partially isolate the pressure of the interior of the tubular body from the pressure of the exterior of the tubular body. The valve assembly further includes a first ball enclosed within the first funnel which is configured to dissolve in response to contact with a first specified fluidic material, and a second ball enclosed within the second funnel which includes a coating around a core. The coating is configured to dissolve in response to contact with a second specified fluidic material.

In a second aspect accordance with the first aspect, the first specified fluidic material can be an aqueous fluid and the second specified fluidic material can be an aqueous fluid.

In a third aspect accordance with the first or the second aspects, the first specified fluidic material can be a hydrocarbon fluid and the second specified fluidic material can be an aqueous fluid.

In a fourth aspect accordance with any of the first through third aspects, at least one of the first ball and the second ball can be spherical.

In a fifth aspect in accordance with any of the first through fourth aspects, at least one of the first ball and the second ball can be not spherical.

In a sixth aspect in accordance with any of the first through fifth aspects, the coating of the second ball can be a second coating of the second ball and the first coating of the second ball can be disposed around the second coating.

In a seventh aspect in accordance with any of the first through sixth aspects, the second coating has a different dissolution rate in the second fluidic material than a dissolution rate of the first coating in the second fluidic material.

In an eighth aspect in accordance with any of the first through seventh aspects, the valve assembly can be configured such that, with the tubular body disposed in the wellbore and the first ball in an un-dissolved state, the first ball is urged against the connecting port in response to the pressure of the interior of the tubular body exceeding the pressure of the exterior of the tubular body, the first ball thereby preventing flow of fluid through the connecting port from the interior of the tubular body to the exterior of the tubular body, and, then, in response to a reduction in pressure in the interior of the tubular body such that the pressure of the exterior of the tubular body exceeds the pressure of the interior of the tubular body, the first ball is pushed away from the ball seat, thereby permitting a flow of fluid through the connecting port from the exterior of the tubular body to the interior of the tubular body, wherein: (i) the first ball at least partially dissolves in response to contact with the first specified fluidic material in the flow of fluid through the connecting port from the exterior of the tubular body to the interior of the tubular body, and (ii) the coating of the second ball at least partially dissolves in response to contact with the second specified fluidic material in the flow of fluid through the connecting port from the exterior of the tubular body to the interior of the tubular body.

In a ninth aspect in accordance with the eighth aspect, as the coating of the second ball at least partially dissolves, a resulting reduction in a diameter of the second ball permits the second ball to translate within the second funnel towards the connecting port, thereby at least partially blocking ports of the second funnel and progressively reducing the flow of fluid through the connecting port from exterior of the tubular body to the interior of the tubular body as the second ball translates towards the connecting port.

In a tenth aspect in accordance with the eighth aspect, if at least a specified reduction in diameter of the first ball occurs in response to the at least partially dissolving of first ball, then the first ball does not block the connecting port in response to the pressure of the interior of the tubular body exceeding the pressure of the exterior of the tubular body and flow of fluid is thereby permitted from the interior of the tubular body and the exterior of the tubular body.

In an eleventh aspect in accordance with the eighth aspect, if the coating of the second ball is fully dissolved and the core is urged against the communication port in response to the pressure of the exterior of the tubular body exceeding the pressure of the interior of the tubular body, the core substantially prevents flow of fluid through the connecting port from the exterior of the tubular body to the interior of the tubular body.

In a twelfth aspect, a well production system includes a tubular body disposed in a wellbore and valve assembly disposed on the tubular body. The valve assembly includes a first funnel and a second funnel. The first funnel includes a plurality of inlet ports exposed to a pressure of an interior of the tubular body. The second funnel includes a plurality of inlet ports exposed to a pressure of an exterior of the tubular body. The first funnel and the second funnel narrow towards a connecting port, which is connecting port defined by and penetrates through a pressure wall. The pressure wall is configured to, when the valve assembly is disposed on the tubular body, at least partially isolate the pressure of the interior of the tubular body from the pressure of the exterior of the tubular body. The valve assembly further includes a first ball enclosed within the first funnel which is configured to dissolve in response to contact with a first specified fluidic material, and a second ball enclosed within the second funnel which includes a coating around a core. The coating is configured to dissolve in response to contact with a second specified fluidic material.

In a thirteenth eighth aspect in accordance with the twelfth aspect, the valve assembly can be configured such that, with the tubular body disposed in the wellbore and the first ball in an un-dissolved state, the first ball is urged against the connecting port in response to the pressure of the interior of the tubular body exceeding the pressure of the exterior of the tubular body, the first ball thereby preventing flow of fluid through the connecting port from the interior of the tubular body to the exterior of the tubular body, and, then, in response to a reduction in pressure in the interior of the tubular body such that the pressure of the exterior of the tubular body exceeds the pressure of the interior of the tubular body, the first ball is pushed away from the ball seat, thereby permitting a flow of fluid through the connecting port from the exterior of the tubular body to the interior of the tubular body, wherein: (i) the first ball at least partially dissolves in response to contact with the first specified fluidic material in the flow of fluid through the connecting port from the exterior of the tubular body to the interior of the tubular body, and (ii) the coating of the second ball at least partially dissolves in response to contact with the second specified fluidic material in the flow of fluid through the connecting port from the exterior of the tubular body to the interior of the tubular body.

In a fourteenth aspect in accordance with the twelfth or thirteenth aspects, as the coating of the second ball at least partially dissolves, a resulting reduction in a diameter of the second ball permits the second ball to translate within the second funnel towards the connecting port, thereby at least partially blocking ports of the second funnel and progressively reducing the flow of fluid through the connecting port from exterior of the tubular body to the interior of the tubular body as the second ball translates towards the connecting port.

In a fifteenth aspect in accordance with any of the twelfth through fourteenth aspects, if at least a specified reduction in diameter of the first ball occurs in response to the at least partially dissolving of first ball, then the first ball does not block the connecting port in response to the pressure of the interior of the tubular body exceeding the pressure of the exterior of the tubular body and flow of fluid is thereby permitted from the interior of the tubular body and the exterior of the tubular body.

In a sixteenth in accordance with any of the twelfth through fifteenth aspects, if the coating of the second ball is fully dissolved and the core is urged against the communication port in response to the pressure of the exterior of the tubular body exceeding the pressure of the interior of the tubular body, the core substantially prevents flow of fluid through the connecting port from the exterior of the tubular body to the interior of the tubular body.

In a sixteenth aspect in accordance with any of the twelfth through fifteenth aspects, the tubular body comprises production tubing and the valve assembly is a component of a sleeve assembly attached to the production tubing.

In a seventeenth aspect in accordance with any of the twelfth through fifteenth aspects, the tubular body comprises production tubing and the valve assembly is a component of a sub threaded to the production tubing.

In an eighteenth aspect, a method of well operations includes disposing, in a wellbore, a tubular body with a wellbore valve assembly disposed thereon. The valve assembly includes a first funnel and a second funnel. The first funnel includes a plurality of inlet ports exposed to a pressure of an interior of the tubular body. The second funnel includes a plurality of inlet ports exposed to a pressure of an exterior of the tubular body. The first funnel and the second funnel narrow towards a connecting port, which is connecting port defined by and penetrates through a pressure wall. The pressure wall is configured to, when the valve assembly is disposed on the tubular body, at least partially isolate the pressure of the interior of the tubular body from the pressure of the exterior of the tubular body. The valve assembly further includes a first ball enclosed within the first funnel which is configured to dissolve in response to contact with a first specified fluidic material, and a second ball enclosed within the second funnel which includes a coating around a core. The coating is configured to dissolve in response to contact with a second specified fluidic material. The method further includes, when the tubular body is disposed in the wellbore and the first ball in an un-dissolved state, increasing a pressure of the interior of the tubular body such that the pressure of the interior of the tubular body exceeds a pressure of the exterior of the tubular body, thereby urging the first ball against the connecting port, and then reducing the pressure in the interior of the tubular body such that the pressure of the exterior of the tubular body exceeds the pressure of the interior of the tubular body such that the first ball is pushed away from the ball seat, thereby permitting a flow of fluid through the connecting port from the exterior of the tubular body to the interior of the tubular body. The first ball at least partially dissolves in response to contact with the first specified fluidic material in the flow of fluid through the connecting port from the exterior of the tubular body to the interior of the tubular body. The coating of the second ball at least partially dissolves in response to contact with the second specified fluidic material in the flow of fluid through the connecting port from the exterior of the tubular body to the interior of the tubular body.

In a twentieth aspect in accordance with the nineteenth aspect, as the coating of the second ball at least partially dissolves, a resulting reduction in a diameter of the second ball permits the second ball to translate within the second funnel towards the connecting port, thereby at least partially blocking ports of the second funnel and progressively reducing the flow of fluid through the connecting port from exterior of the tubular body to the interior of the tubular body as the second ball translates towards the connecting port.

In a twenty-first aspect in accordance with the nineteenth or twentieth aspects, the valve assembly is configured such that, when the coating of the second ball is fully dissolved and the core is urged against the communication port in response to the pressure of the exterior of the tubular body exceeding the pressure of the interior of the tubular body, the core substantially prevents flow of fluid through the connecting port from the exterior of the tubular body to the interior of the tubular body.

In a twenty-second aspect accordance with any of the nineteenth through twenty-first aspects, the method further includes, after at least a specified reduction in diameter of the first ball has occurred in response to the at least partially dissolving of first ball, flowing a stimulation fluid from the interior of the tubular body and the exterior of the tubular body.

As used in this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

As used in this disclosure, the term "about" or "approximately" can allow for a degree of variability in a value or range, for example, within 10%, within 5%, or within 1% of a stated value or of a stated limit of a range.

As used in this disclosure, "weight percent" (wt %) can be considered a mass fraction or a mass ratio of a substance to the total mixture or composition. Weight percent can be a weight-to-weight ratio or mass-to-mass ratio, unless indicated otherwise As used in this disclosure, the term "substantially" refers to a majority of, or mostly, as in at least about 50%, 60%, 70%, 80%, 90%, 95%, 96%, 97%, 98%, 99%, 99.5%, 99.9%, 99.99%, or at least about 99.999% or more.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

The invention claimed is:

1. A valve assembly configured to be disposed on a tubular body configured to be disposed in a wellbore, the valve assembly comprising:

a first funnel comprising a plurality of inlet ports exposed to a pressure of an interior of the tubular body;

a second funnel comprising a plurality of inlet ports exposed to a pressure of an exterior of the tubular body, the first funnel and the second funnel narrowing towards a connecting port, the connecting port defined by and penetrating through a pressure wall, the pressure wall configured to, when the valve assembly is disposed on the tubular body, at least partially isolate the pressure of the interior of the tubular body from the pressure of the exterior of the tubular body;

a first ball enclosed within the first funnel, the first ball configured to dissolve in response to contact with a first specified fluidic material; and a second ball enclosed within the second funnel, the second ball comprising a coating around a core, the coating configured to dissolve in response to contact with a second specified fluidic material.

2. The valve assembly of claim 1, wherein the first specified fluidic material is an aqueous fluid and the second specified fluidic material is an aqueous fluid.

3. The valve assembly of claim 1, wherein the first specified fluidic material is a hydrocarbon fluid and the second specified fluidic material is an aqueous fluid.

4. The valve assembly of claim 1, wherein at least one of the first ball and the second ball is spherical.

5. The valve assembly of claim 1, wherein at least one of the first ball and the second ball is not spherical.

6. The valve assembly of claim 1, wherein the coating of the second ball is a second coating of the second ball and wherein a first coating of the second ball is disposed around the second coating.

7. The valve assembly of claim 6, wherein the second coating has a different dissolution rate in the second fluidic material than a dissolution rate of the first coating in the second fluidic material.

8. The valve assembly of claim 1, wherein the valve assembly is configured such that:

with the tubular body disposed in the wellbore and the first ball in an un-dissolved state, the first ball is urged against the connecting port in response to the pressure of the interior of the tubular body exceeding the pressure of the exterior of the tubular body, the first ball thereby preventing flow of fluid through the connecting port from the interior of the tubular body to the exterior of the tubular body; and then, in response to a reduction in pressure in the interior of the tubular body such that the pressure of the exterior of the tubular body exceeds the pressure of the interior of the tubular body, the first ball is pushed away from the ball seat, thereby permitting a flow of fluid through the connecting port from the exterior of the tubular body to the interior of the tubular body, wherein:

(i) the first ball at least partially dissolves in response to contact with the first specified fluidic material in the flow of fluid through the connecting port from the exterior of the tubular body to the interior of the tubular body; and (ii) the coating of the second ball at least partially dissolves in response to contact with the second specified fluidic material in the flow of fluid through the connecting port from the exterior of the tubular body to the interior of the tubular body.

9. The valve assembly of claim 8, wherein, as the coating of the second ball at least partially dissolves, a resulting reduction in a diameter of the second ball permits the second ball to translate within the second funnel towards the connecting port, thereby at least partially blocking ports of the second funnel and progressively reducing the flow of fluid through the connecting port from exterior of the tubular body to the interior of the tubular body as the second ball translates towards the connecting port.

10. The valve assembly of claim 8 wherein, if at least a specified reduction in diameter of the first ball occurs in response to the at least partially dissolving of first ball, then the first ball does not block the connecting port in response to the pressure of the interior of the tubular body exceeding the pressure of the exterior of the tubular body and flow of fluid is thereby permitted from the interior of the tubular body and the exterior of the tubular body.

11. The valve assembly of claim 8, wherein if the coating of the second ball is fully dissolved and the core is urged against the communication port in response to the pressure of the exterior of the tubular body exceeding the pressure of the interior of the tubular body, the core substantially prevents flow of fluid through the connecting port from the exterior of the tubular body to the interior of the tubular body.

12. A well production system comprising:

a tubular body disposed in a wellbore;

a valve assembly disposed on the tubular body, the valve assembly comprising:

a first funnel comprising a plurality of inlet ports exposed to a pressure of an interior of the tubular body;

a second funnel comprising a plurality of inlet ports exposed to a pressure of an exterior of the tubular body, the first funnel and the second funnel narrowing towards a connecting port, the connecting port defined by, and penetrating through, a pressure wall at least partially isolating the pressure of the interior of the tubular body from the pressure of the exterior of the tubular body;

a first ball enclosed within the first funnel, the first ball configured to dissolve in response to contact with a first specified fluidic material; and a second ball enclosed within the second funnel, the second ball comprising a coating around a core, the coating configured to dissolve in response to contact with a second specified fluidic material.

13. The well production system claim 12, wherein the valve assembly is configured such that:

with the first ball in an un-dissolved state, the first ball is urged against the connecting port in response to the pressure of the interior of the tubular body exceeding the pressure of the exterior of the tubular body, the first ball thereby preventing flow of fluid through the connecting port from the interior of the tubular body to the exterior of the tubular body; and then, in response to a reduction in pressure in the interior of the tubular body such that the pressure of the exterior of the tubular body exceeds the pressure of the interior of the tubular body, the first ball is pushed away from the ball seat, thereby permitting a flow of fluid through the connecting port from the exterior of the tubular body to the interior of the tubular body, wherein:

(i) the first ball at least partially dissolves in response to contact with the first specified fluidic material in the flow of fluid through the connecting port from the exterior of the tubular body to the interior of the tubular body; and (ii) the coating of the second ball at least partially dissolves in response to contact with the second specified fluidic material in the flow of fluid through the connecting port from the exterior of the tubular body to the interior of the tubular body.

14. The well production system of claim 13, wherein, as the coating of the second ball at least partially dissolves, a resulting reduction in a diameter of the second ball permits the second ball to translate within the second funnel towards the connecting port, thereby at least partially blocking ports of the second funnel and progressively reducing the flow of fluid through the connecting port from exterior of the tubular body to the interior of the tubular body as the second ball translates towards the connecting port.

15. The well production system of claim 13, wherein, if at least a specified reduction in diameter of the first ball occurs in response to the at least partially dissolving of first ball, then the first ball does not block the connecting port in response to the pressure of the interior of the tubular body exceeding the pressure of the exterior of the tubular body and flow of fluid is thereby permitted from the interior of the tubular body and the exterior of the tubular body.

16. The well production system of claim 13, wherein if the coating of the second ball is fully dissolved and the core is urged against the communication port in response to the pressure of the exterior of the tubular body exceeding the pressure of the interior of the tubular body, the core substantially prevents flow of fluid through the connecting port from the exterior of the tubular body to the interior of the tubular body.

17. The well production system of claim 12, wherein the tubular body comprises production tubing and wherein the valve assembly is a component of a sleeve assembly attached to the production tubing.

18. The well production system of claim 12, wherein the tubular body comprises production tubing and wherein the valve assembly is a component of a sub threaded to the production tubing.

19. A method of well operations, the method comprising:

disposing, in a wellbore, a tubular body with a wellbore valve assembly disposed thereon, the valve assembly comprising:

a first funnel comprising a plurality of inlet ports exposed to a pressure of an interior of the tubular body;

a second funnel comprising a plurality of inlet ports exposed to a pressure of an exterior of the tubular body, the first funnel and the second funnel narrowing towards a connecting port, the connecting port defined by, and penetrating through, a pressure wall at least partially isolating the pressure of the interior of the tubular body from the pressure of the exterior of the tubular body;

a first ball enclosed within the first funnel, the first ball configured to dissolve in response to contact with a first specified fluidic material; and a second ball enclosed within the second funnel, the second ball comprising a coating around a core, the coating configured to dissolve in response to contact with a second specified fluidic material;

with the tubular body disposed in the wellbore and the first ball in an un-dissolved state, increasing a pressure of the interior of the tubular body such that the pressure of the interior of the tubular body exceeds a pressure of the exterior of the tubular body, thereby urging the first ball against the connecting port; and then, reducing the pressure in the interior of the tubular body such that the pressure of the exterior of the tubular body exceeds the pressure of the interior of the tubular body such that the first ball is pushed away from the ball seat, thereby permitting a flow of fluid through the connecting port from the exterior of the tubular body to the interior of the tubular body, wherein:

(i) the first ball at least partially dissolves in response to contact with the first specified fluidic material in the flow of fluid through the connecting port from the exterior of the tubular body to the interior of the tubular body; and (ii) the coating of the second ball at least partially dissolves in response to contact with the second specified fluidic material in the flow of fluid through the connecting port from the exterior of the tubular body to the interior of the tubular body.

20. The method of claim 19, wherein, as the coating of the second ball at least partially dissolves, a resulting reduction in a diameter of the second ball permits the second ball to translate within the second funnel towards the connecting port, thereby at least partially blocking ports of the second funnel and progressively reducing the flow of fluid through the connecting port from exterior of the tubular body to the interior of the tubular body as the second ball translates towards the connecting port.

21. The method of claim 19, wherein the valve assembly is configured such that, when the coating of the second ball is fully dissolved and the core is urged against the communication port in response to the pressure of the exterior of the tubular body exceeding the pressure of the interior of the tubular body, the core substantially prevents flow of fluid through the connecting port from the exterior of the tubular body to the interior of the tubular body.

22. The method of claim 19, further comprising, after at least a specified reduction in diameter of the first ball has occurred in response to the at least partially dissolving of first ball, flowing a stimulation fluid from the interior of the tubular body and the exterior of the tubular body.

* * * * *